United States Patent [19]

Carbert

[11] Patent Number: 4,660,729

[45] Date of Patent: Apr. 28, 1987

[54] METHOD AND APPARATUS FOR PREVENTING BOOM OVERLOAD

[75] Inventor: Ralph E. Carbert, Minneapolis, Minn.

[73] Assignee: Hugh E. Carbert, Maple Plain, Minn.

[21] Appl. No.: 776,789

[22] Filed: Sep. 16, 1985

[51] Int. Cl.[4] ..... B66C 13/18

[52] U.S. Cl. ..... 212/149; 212/261

[58] Field of Search ..... 212/149, 150, 153, 154, 212/155, 255, 261, 266, 151; 901/49

[56] References Cited

U.S. PATENT DOCUMENTS

| | | | |
|---|---|---|---|
| 3,447,692 | 6/1969 | Thomas | 212/151 |
| 3,952,879 | 4/1976 | Grove | 212/149 |
| 3,963,127 | 6/1976 | Eriksson | 212/149 |
| 4,027,772 | 6/1977 | Garber | 212/149 |
| 4,135,632 | 1/1979 | Berkel | 212/153 |
| 4,368,824 | 1/1983 | Thomasson | 212/150 |

FOREIGN PATENT DOCUMENTS

| | | | |
|---|---|---|---|
| 208225 | 1/1966 | U.S.S.R. | 212/149 |

*Primary Examiner*—Joseph F. Peters, Jr.
*Assistant Examiner*—Stephen P. Avila
*Attorney, Agent, or Firm*—Schroeder & Siegfried

[57] ABSTRACT

A boom overload protection apparatus generally used in the protection of derrick-type hydraulic equipment having a boom or power arm for lifting or maneuvering heavy objects. A sensing rod is longitudinally connected to said boom in such manner as to sense boom overload relative to a predetermined allowable degree of flex. As boom overload is sensed, the sensing rod mechanically actuates a sensing valve through tensional or compressive forces applied thereto. The sensing valve, in turn, releases the fluid pressure in pressure release lines connected to overstress valve means. This release of fluid pressure actuates the overstress valve means which is connected in controlling relation to each hydraulic cylinder and winch drive to thereby disable boom stress-inducing operation of the same until such over-stress condition may be relieved.

19 Claims, 6 Drawing Figures

METHOD AND APPARATUS FOR PREVENTING BOOM OVERLOAD

BACKGROUND OF THE PRIOR ART

Prior art overstress protection devices are functionally sensitive to the fluid pressure of the hydraulic system. In such systems, a load applied to the boom in certain positions, will cause a high pressure overload to be sensed within the hydraulic system, but the same load carried by the boom positioned in a different configuration may not cause such a pressure overload. Consequently, under such circumstances, the boom is often overloaded without causing a pressure overload within the hydraulic system. As a further consequence, booms are quite often permanently bent and seriously damaged. For example, the same load will cause much greater pressure within the hydraulic cylinders when the boom is in the completely extended position, than when the boom is positioned in a configuration bending acutely at its elbow joint. Thus, the boom while at an acute angle may be seriously overloaded by the operator without the overload sensors detecting same, thereby causing serious damage to the boom.

Moreover, if a lower pressure limit is selected to compensate for the possible overloading of the boom while configured in such acute angle positions, then the utility of the hydraulic derrick-type equipment is seriously limited with respect to use of the same when the arm is at its full extension, since only small loads could be safely carried, thereby defeating a major purpose of the equipment. Thus, by using my improved overload protection apparatus, this problem is effectively eliminated since my invention senses overload conditions as a function of the extent of boom flex.

BRIEF SUMMARY OF THE INVENTION

The present invention is an improved apparatus for protecting hydraulic derrick-type equipment from overstress conditions caused by overloading its boom or power arm. Operation of the protection apparatus depends upon sensing overstress conditions as a function of overflexing in the boom or power arm.

The present invention utilizes a mechanical sensing rod connected to the outermost end of a boom and extending along its longitudinal axis to a sensing valve also connected to said boom. The sensing valve is mechanically actuated through tensional or compressive forces transmitted through the sensing rod as a result of the boom flexing beyond a predetermined allowable degree. Because the boom is pivotable about its elbow joint, the sensing rod may be located on the top side or underside of the boom at any time, depending upon the orientation of the boom and it may be disposed within the boom or upon the exterior of the boom, as shown. Thus, when the sensing rod is on the top surface of the boom, boom flex will cause tensional forces to be transmitted through the sensing rod to its sensing valve. When the sensing rod is on the lower surface of the boom, boom flex will cause compressive forces to be transmitted through the sensing rod to the sensing valve.

Because the sensing rod may transmit either tensional or compressive forces, the sensing valve must be capable of being actuated by either. To accommodate this need, the sensing rod is connected to a mechanical actuation pivot arm which pivots when tensional or compressive forces are transmitted through the sensing rod.

The pivot arm mechanically actuates one of a pair of flow valves contained inside the sensing valve. Upon actuation of either flow valve, fluid pressure contained in pressure release lines is released through the sensing valve to a main tank reservoir.

By releasing the fluid pressure through the sensing valve, overstress valve means which are connected to said pressure release lines are actuated, thereby disabling stress-inducing operation of such equipment until the operator releases the control valves. Release of the hydraulic control valves relaxes the overstress valve means and allows the same to reset to its normal operating mode. Once the overstress valve means have reset, the hydraulic equipment can be backed off to relieve the overstress condition in the boom. However, operation of the fluid power motors in a stress-inducing direction will simply cause reactivation of the sensing valve and overstress valve means.

It is the primary objective of the present invention to provide a boom overload protection apparatus which is sensitive to overflexing of a boom beyond a predetermined allowable degree of flex.

It is a further objective of this invention to provide an improved, more accurate means of detecting overstress in hydraulic derrick-type equipment.

BRIEF DESCRIPTION OF THE DRAWINGS

A detailed description of one preferred embodiment of the Method & Apparatus for Preventing Boom Overload is hereafter described with specific reference being made to the drawings in which.

DETAILED DESCRIPTION OF THE INVENTION

Figure 1:
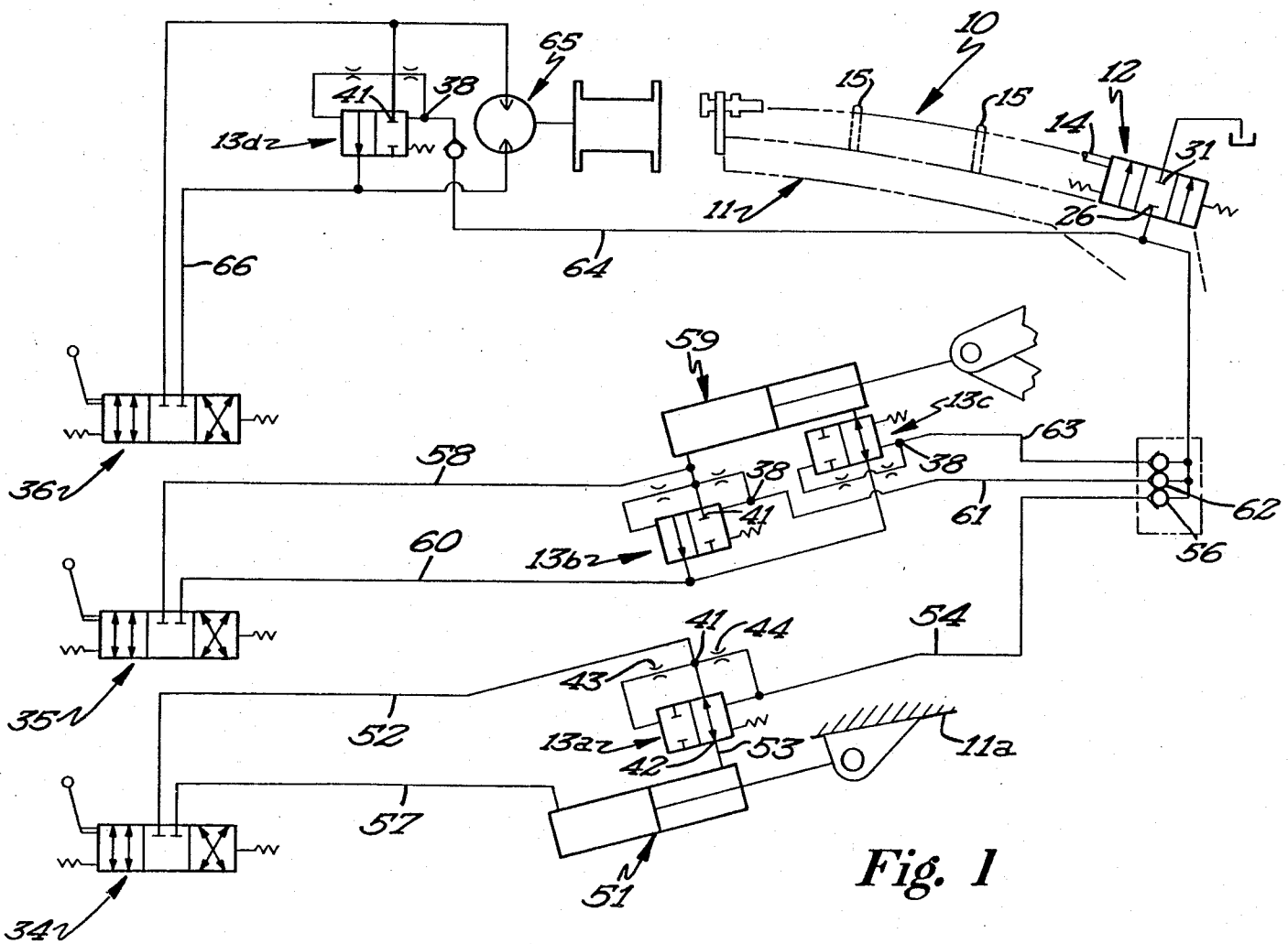
FIG. 1 is a schematic diagram which illustrates the manner in which my invention is applied and used to protect a boom or power arm from damage caused by overloading the boom.

My invention, as shown schematically in FIG. 1, is directed generally to the protection of derrick-type hydraulic equipment having a boom, or power arm, for lifting and maneuvering heavy objects. A common source (not shown) of adequate hydraulic pressure is connected to control valves (34), (35), and (36) which control the operation of fluid powered drive units for manuevering the boom and load. The drive units in the preferred embodiment are comprised of topping cylinder (5), elbow cylinder (51), and winch drive (65), but are not limited thereto.

Basically, my invention includes a sensing means (10) connected to boom (11), which generally is of dialectric construction, in such manner as to sense boom overload relative to a predetermined allowable degree of flex, and an overstress relief means, including a sensing valve (12) and overstress valve means (13).

Once the boom (11) has flexed beyond a predetermined allowable degree of flex, the sensing means (10) mechanically actuates sensing valve (12), thereby releasing the fluid pressure in pressure release lines (54), (61), (63), and (64). This release of fluid pressure, in turn, actuates overstress valve means, (13*a*), (13*b*), (13*c*), and (13*d*).

Overstress valve means (13*a*) prohibits topping cylinder (51) from being restricted further, and overstress valve means (13*d*) prohibits any further lifting of a load by the winch drive (65). Overstress valve means (13*b*) and (13*c*) function to disable operation of elbow cylinder (59). The combinational effect of said overstress valve means prohibits any further stress inducing operation of overstressed boom (11). Conventional holding valves (not shown) maintains the status quo of the equipment when sensing valve (12) is activated.

However, normal operation is restored by simply lowering the load from winch drive (65) or expanding topping cylinder (51), either of which relieves the overstressed condition in boom (11).

Figure 2:
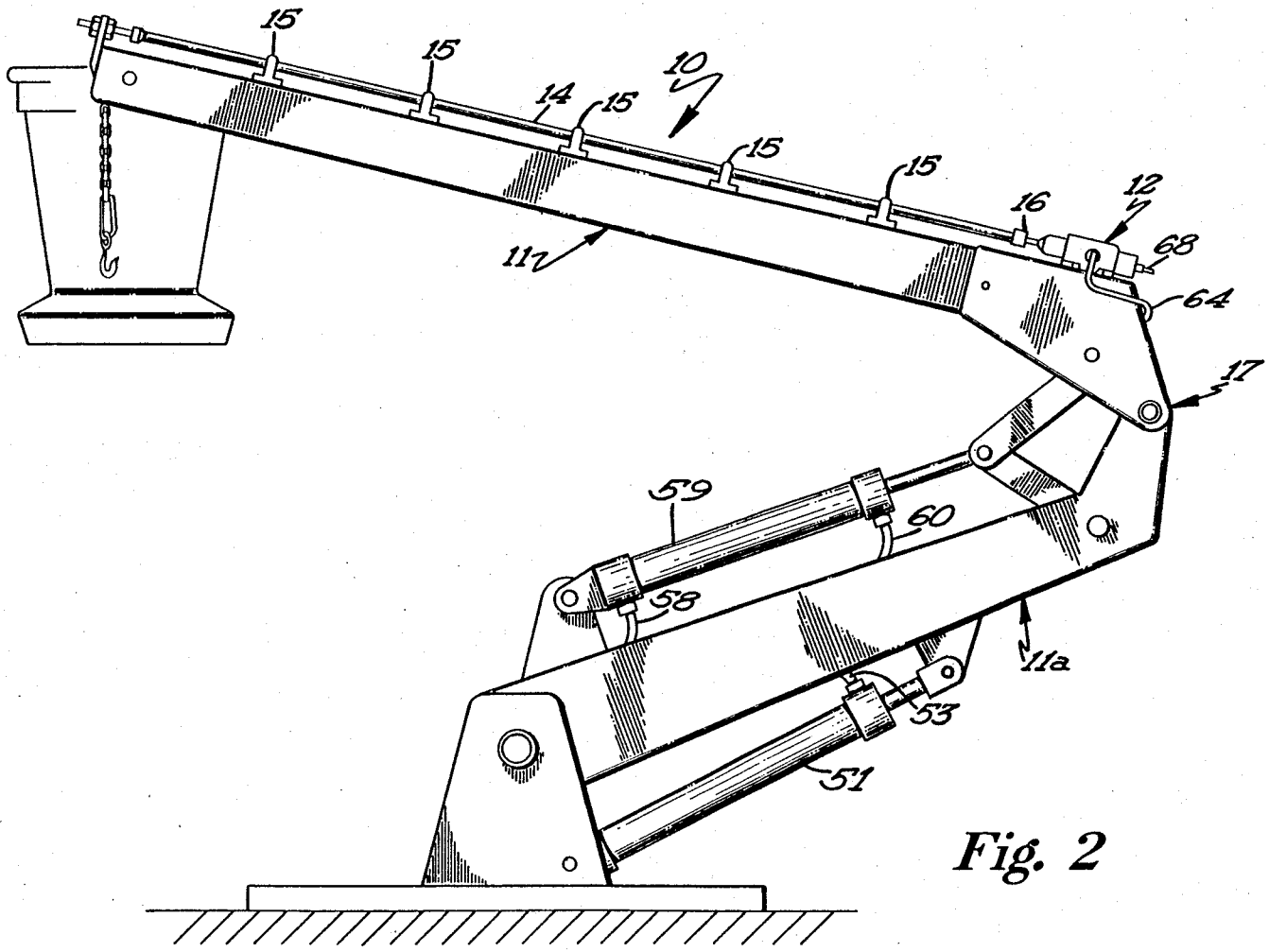
FIG. 2 is a side elevation of a boom carrying my flex sensing device and supported by the booms lower arm.

In particular, my invention as shown in FIG. 2 includes a sensing rod (14), having one end fixedly connected to the outermost end of boom (11) and extending along the longitudinal axis of boom (11) through guides (15). Sensing rod (14) is mechanically connected at its other end to sensing valve (12) by means of actuation pivot arm (16) at a point adjacent to elbow joint (17).

Sensing rod (14) and sensing valve (12) are preferably mounted on either the uppermost or lowermost surface of boom (11) to effectively sense any boom flex therein. If sensing rod (14) and sensing valve (12) are located on the underside of boom (11), it will cause compressive forces to be transmitted through sensing rod (14) to sensing valve (12). On the other hand, if sensing rod (14) and sensing valve (12) are located on the top side of boom (11), then downward flexing of the same will cause tensional forces to be transmitted through sensing rod (14) to sensing valve (12). Because boom (11) pivots about elbow joint (17), sensing rod (14) and sensing valve (12) may be positioned on either the top side or underside of boom (11) at any given time. Therefore, sensing valve (12) will actuate when either tensional or compressive forces are transmitted thereto through sensing rod (14).

Figure 3:
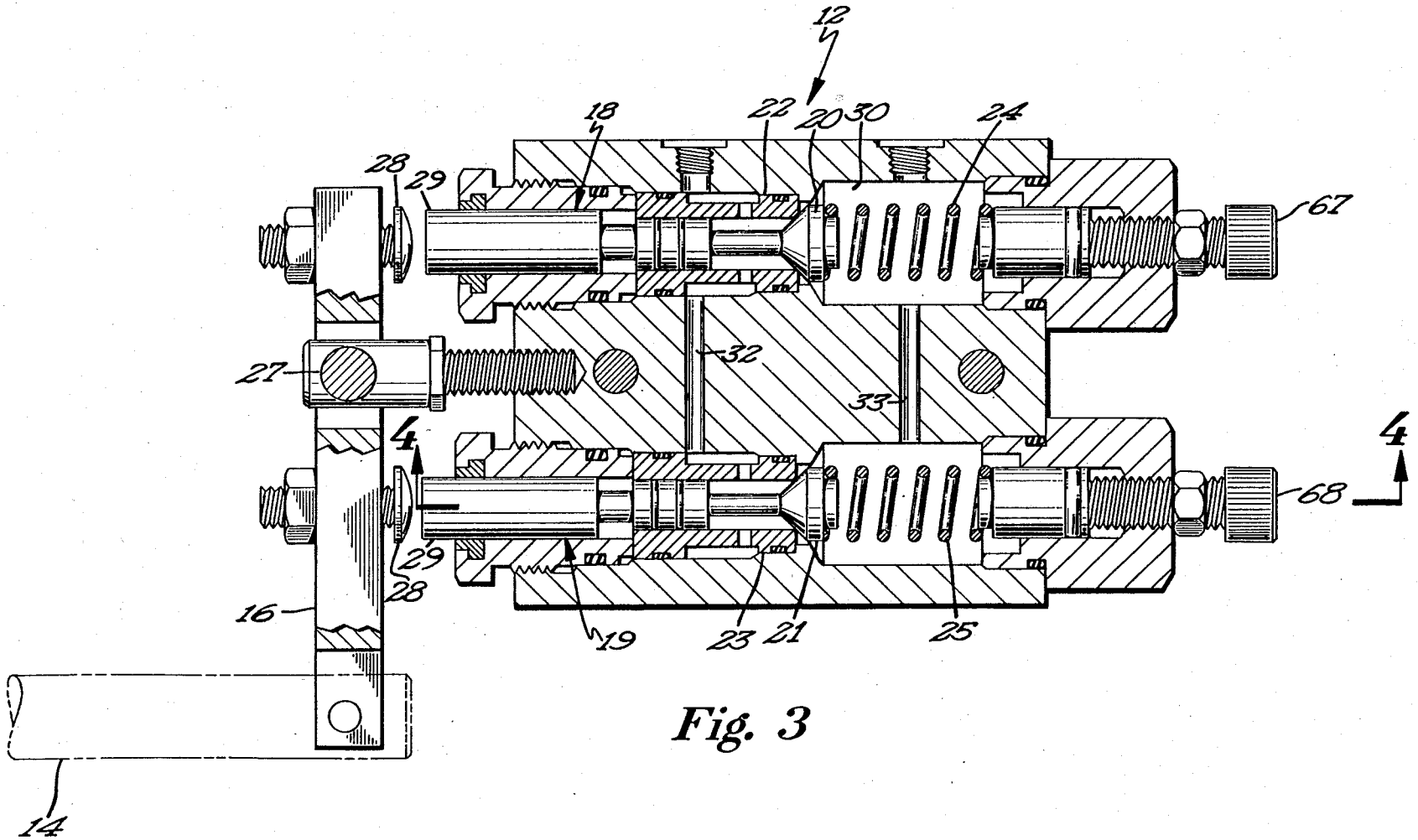
FIG. 3 is a horizontal sectional view of the sensing valve, with its pivot arm shown in elevation.
Figure 4:
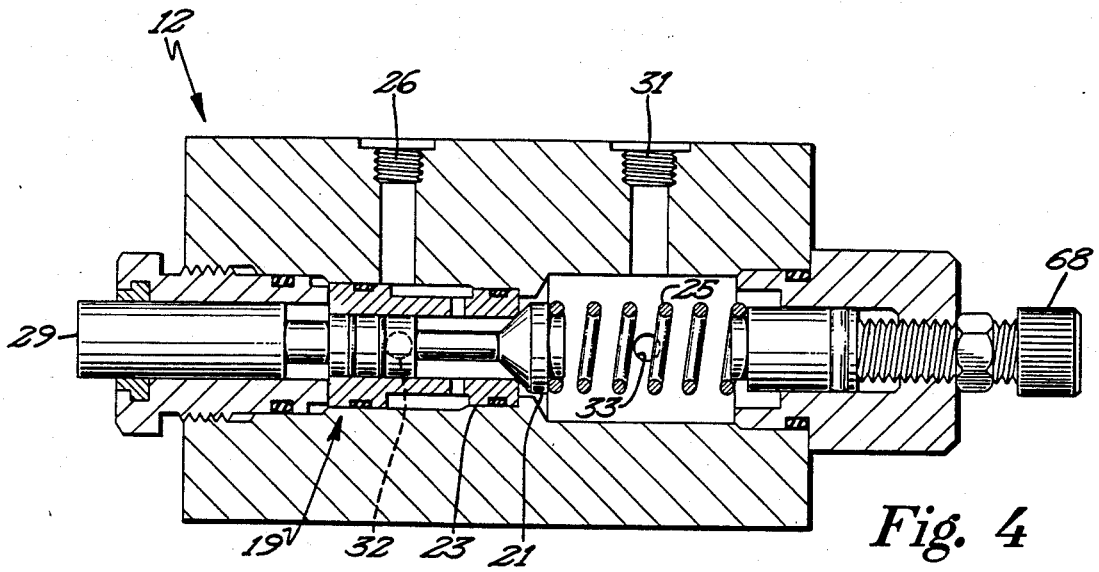
FIG. 4 is a vertical sectional view taken through the lower of the two valves shown in FIG. 3.

As shown in FIG. 3, sensing valve (12) is equipped with a pair of interconnecting mechanically actuated flow valves, (18) and (19). Both flow valves, (18) and (19), are held in a normally closed position so that the operating fluid pressure in pressure release lines (54), (61), (63), and (64) is maintained. To accomplish this, poppet valves (20) and (21) are held seated against housings (22) and (23) by bias springs (24) and (25) respectively. Thus, as shown in FIG. 4, the fluids entering inlet port (26) are normally trapped within housing (22) and (23) and are not allowed to flow through outlet port (31) to a main tank reservoir (not shown) until sensing valve (12) is actuated.

When boom (11) flexes beyond its predetermined allowable degree, causing tensional forces to be transmitted through sensing rod (14), the mechanically connected actuation pivot arm (16) pivots about joint (27), thereby causing cam (28) to mechanically push actuation pin (29) against poppet valve (20). When the transmitted tensional force becomes great enough due to overflexing in boom (11), the force will unseat poppet valve (20) from housing (22), thereby releasing the fluid pressure from pressure release lines (54), (61), (63), and (64) through chamber (30) and outlet port (31) to a main tank reservoir.

The necessary force to unseat poppet valve (20) from housing (22) is predetermined by adjusting adjustment screws (67) and (68). Tightening of screws (67) and (68) will increase the force exerted on poppet valve (20) by spring (24) thereby increasing the force required to be transmitted through sensing rod (14) to unseat poppet valve (20) from housing (22). As the degree of boom flex determines the extent of movement transmitted through sensing rod (14) to sensing valve (12), the degree of boom flex necessary to actuate sensing valve (12) may be adjusted by adjustment of cams (28).

As flow valves (18) and (19) are identical in function, a description of the operation of sensing valve (12) need not be repeated for circumstances resulting in compressive forces being transmitted through sensing rods (14) to sensing valve (12). It need only be stated that, under such circumstances, the actuation pivot arm (16) pivots about joint (27) and actuates flow valve (19) in the same manner as stated above. Because flow valves (18) and (19) are interconnected through cross conduits (32) and (33), the incoming fluid pressure will be released through outlet port (31) to the main tank reservoir regardless of which flow valve, (18) or (19), is actuated.

Actuation of sensing valve (12), which releases the fluid pressure in pressure release lines (54), (61), (63), and (64), activates overstress valve means (13*a*), (13*b*), (13*c*), and (13*d*).

As stated before, overstress valve means (13*a*), (13*b*), (13*c*), and (13*d*), when actuated, function to disable stress inducing operation of topping cylinder (51), elbow cylinder (59), and winch drive (65). Each overstress valve (13*a*), (13*b*), (13*c*), and (13*d*) is identically constructed and operates in a manner described hereinbelow. Thus, it will suffice to describe the operation of only one such overstress valve means (13). Model 902 overstress valves which are of the type used in my invention, can be purchased through R.C. Hydraulics Incorporated, 3401 Yukon Avenue South, Minneapolis, Minn. 55426.

Figure 5:
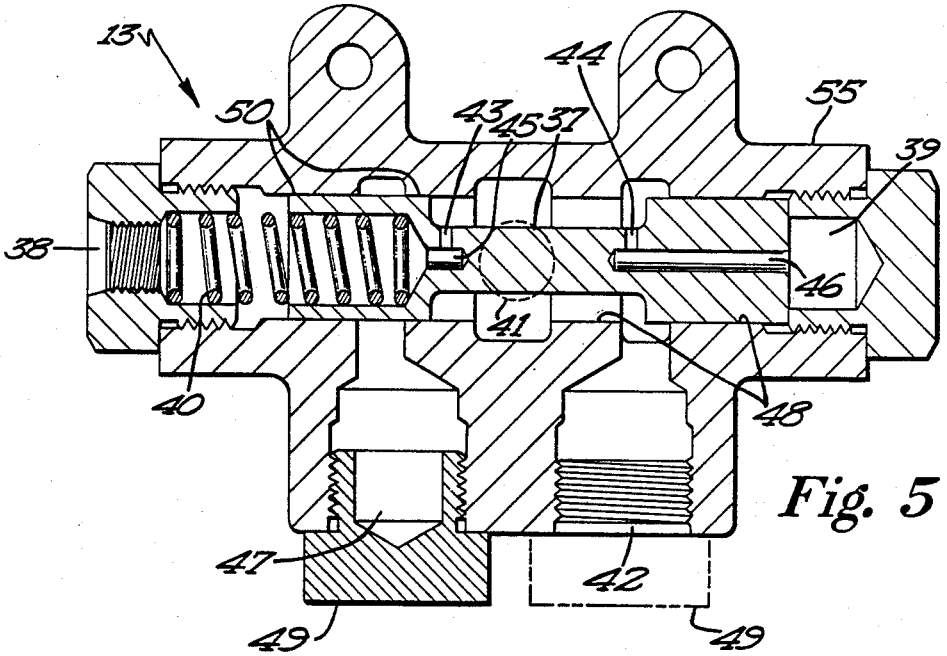
FIG. 5 is a horizontal sectional view of the overstress valve in normally open position and with modification thereof needed to show the same in normally closed position being shown in broken lines.
Figure 6:
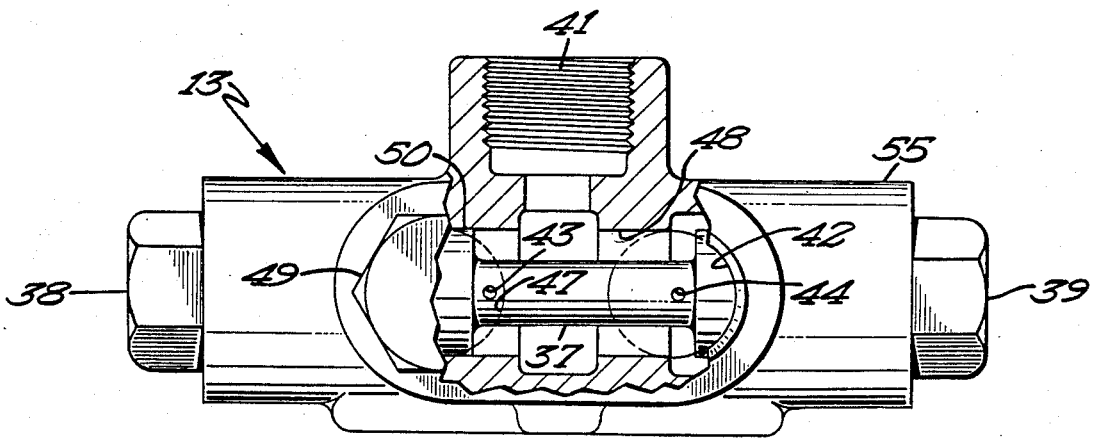
FIG. 6 is a side elevational view of the overstress valve shown in FIG. 5 with the center position broken away to show the inlet port of the same.

As shown in FIGS. 5 and 6, each overstress valve means (13) is comprised of the valve housing (55) encasing a spool valve (37) which is slidable between pressure release port (38) and capped port (39). Spool valve (37) is initially biased off center toward capped port (39) by bias spring (40), thereby providing an open passage between ports (41) and (42). In order to fully understand the operation of the overstress valve means (13), it must be noted that spool valve (37) has orifices (43) and (44) connected to passages (45) and (46) respectively, which function to equalize and maintain static fluid pressure throughout valve housing (55) under normally biased position unless a drop in pressure is detected at pressure release port (38), in which case the pressure differential caused by continued incoming fluid pressure through port (41) on the inner face of land (50) will cause spool valve (37) to overcome the spring bias and shift toward pressure release port (38).

Overstress valve means (13) is capable of being operated in one of two modes; normally open, or normally closed. In order to operate the overstress valve (13) in the normally open configuration, port (42) is left open for fluid passage, and port (47) is capped so that no fluids may flow therethrough. With this configuration, the fluid of the hydraulic system are allowed to freely flow between ports (41) and (42) since spool valve (37) is initially biased by spring (40) so that land (48) of spool valve (37) does not block port (42), thereby allowing such an open passage.

When sensing valve (12) releases the fluid pressure in pressure release lines (54), (61), (63), and (64) due to an overstress condition on boom (11), the fluid pressure at the pressure release port (38) will also drop, causing an imbalance of pressure within overstress valve means (13). As a result, spool valve (37) shifts towards pressure release port (38). By so doing, land (48) of spool valve (37) closes off the open passageway between port (41) and port (42). However, once the incoming fluid pressure at port (41) from control valve (34), (35), and (36) is relieved, the pressure stabilizes within the overstress valve means (13). Then bias spring (40) will again shift spool valve (37) back to its normally biased position, thereby reopening the passageway between ports (41) and (42).

The normally closed mode of operation is provided by simply removing cap (49) from port (47) and capping port (42) with the same. This is illustrated in FIG. 5 by a dashed image of cap (49) over port (42). Securing cap (49) in port (42) has closed off the open passageway between ports (41) and (42). Moreover, land (50) of spool valve (37) closes off the passageway between port (41) and port (47) while spool valve (37) is in its normally biased position. Thus, it is evident that overstress valve (13) is closed off in normal operation, thereby restricting any fluid flow therethrough.

Operation of overstress valve means (13) in the normally closed configuration depends again upon a pressure drop occuring at the pressure release port (38). When sensing valve (12) senses overflexing in boom (11) and releases fluid pressure from the pressure release lines (54), (61), (63), and (64) through outlet port (31), the pressure at the pressure release port (38) instantly drops causing a pressure imbalance in overstress valve means (13). Similar to the normally open configuration, spool valve (37) then shifts toward the pressure release port (38) thereby sliding spool valve (37) away from port (47) and opening a passageway between port (41) and port (47). Again, once the incoming fluid pressure from the control valve (34), (35), and (36) is relieved the pressure stabilizes within overstress valve means (13). Then bias spring (40) causes spool valve (37) to shift back into its normally biased position, thereby closing off all open passageways through overstress valve means (13).

With an understanding of how overstress valve (13) and sensing valve (12) function individually, it is now possible to describe how my invention operates as a whole. Referring back to the schematic drawing in FIG. 1, control valve (34) controls the expansion and retraction of the topping cylinder (51) which controls the movement of lower arm (11*a*). Overstress valve means (13*a*) is connected in the normally open position between retraction line (52) and topping cylinder (51). With reference to FIG. 6, retraction line (52) enters overstress valve means (13*a*) through port (41). Port (42) is directly connected to the topping cylinder (51) with line (53). The pressure release port (38) of overstress valve means (13*a*) is connected to the inlet port (26) of sensing valve (12) by pressure release line (54) through check valve (56). Check valve (56) simply functions to prevent any back flow of fluids through pressure release line (54) into overstress valve means (13*a*).

In normal operation, fluids are freely channeled through normally open overstress valve means (13*a*) to provide bidirectional operation of topping cylinder (51). When boom (11) becomes overloaded, thereby causing the same to flex beyond a predetermined allowable degree of flex, a tensional or compressive force is transmitted through sensing rod (14) to actuate pivot arm (16) which pivots and mechanically actuates sensing valve (12). As noted above, sensing valve (12) is normally closed thereby maintaining an operational fluid pressure within pressure release lines (57), (61), (63), and (64). However, upon mechanical actuation of sensing valve (12), the fluid pressure within said pressure release lines is released and the fluids are allowed to flow through the outlet port (31) of sensing valve (12) to a main tank reservoir.

A drop of pressure at the inlet port (26) of overstress valve (12) consequently drops the pressure through pressure release line (54) to pressure release port (38) of overstress valve means (13*a*). A pressure drop at pressure release port (38) actuates overstress valve means (13*a*), thereby causing spool valve (37) of the same to shift and close off the open passageway between port (41) and port (42). Thus, fluid flow to topping cylinder (51) through retraction line (52) and consequently retraction is interrupted. Once the equipment operator releases the control of control valve (34), thereby dropping the incoming fluid pressure to overstress valve means (13*a*) through port (41), the pressure will stabilize therein.

Once the pressure stabilizes within overstress valve means (13*a*), bias spring (40) returns spool valve (37) to its normally biased position, thereby enabling fluid flow and full operation of topping cylinder (51). However, topping cylinder (51) can only be operated in an expansive direction so as to relieve the overstress condition of an overloaded boom (11). Any further retraction of topping cylinder (51) will simply trip sensing valve (12) again.

Control valve (35) controls the operation of elbow cylinder (59) which in turn controls the movement about elbow joint (17) of boom (11), which may include over-center conditions. Forward control line (58) is connected to the base of elbow cylinder (59) and facilitates the expansion of the same. Reverse control line (60) is connected through normally open overstress valve means (13*c*) to the top end of elbow cylinder (59) and facilitates retraction of the same.

Overstress valve means (13*c*) is connected in the normally open configuration between the rod end of elbow cylinder (59) and reverse control line (60). Overstress valve means (13*c*) is connected and operates in an identical manner as overstress valve (13*a*) operates in connection with topping cylinder (51). Therefore, a detailed discussion of its function is not necessary. It will suffice to say that overstress valve (13*c*) prohibits retraction of elbow cylinder (59) when boom (11) is overloaded and sensing valve (12) is actuated.

Overstress valve means (13*b*) is connected to the base of elbow cylinder (59) in the normally closed configuration between forward control line (58) and reverse control line (60). Referring again to FIG. 6, forward control line (58) is connected to port (41) of overstress valve (13*b*), and reverse control line (60) is connected to port (47) of the same. It will be noted that cap (49) is removed from port (47) and placed in port (42) to provide normally closed operation of overstress valve means (13*b*).

Similar to the operation of overstress valve means (13*a*), the pressure release port (38) of overstress valve means (13*b*) is connected to the inlet port (26) of sensing valve (12) by pressure release line (61) through check valve (62). Check valve (62) simply prevents any fluid back flow through pressure release line (61) into overstress valve means (13*b*).

Under normal operation, overstress valve means (13*b*) is under static pressure from the hydraulic system and no fluid is allowed to flow through the closed overstress valve means (13*b*). Passage of fluids through port (47) is blocked by land (50) of spool valve (37) and port (42) is plugged by cap (49). Thus, expansion of elbow cylinder (59) is directly controlled through forward control line (58).

However, normal operation is interrupted when boom (11) becomes overloaded causing overflexing and consequent actuation of sensing valve (12). Sensing valve (12) releases the fluid pressure in pressure release line (61) thereby creating a drop in pressure at release port (38) of overstress valve means (13*b*). Incoming fluid pressure through forward control line (58) will create a pressure imbalance in overstress valve (13*b*) thereby causing spool (37) to shift toward pressure release port (38) and opening a passageway from port (41) through port (47). At this instant, elbow cylinder (59) is bypassed and the fluid flows freely from forward control line (58) through overstress valve means (13*b*) and back to the main tank reservoir through reverse control line (60).

However, once the incoming fluid pressure from control valve (35) to overstress valve means (13*b*) is discontinued by the operator, the pressure stabilizes within overstress valve means (13*b*). Bias spring (40) then shifts spool valve (37) back into its normally biased position thereby closing off all passageways through overstress valve means (13*b*). Because overstress valve means (13*b*) and (13*c*) are connected to both forward and reverse control lines, (56) and (60), respectively no movement of elbow cylinder (59) is possible before the overstress condition in boom (11) is relieved by manuevering topping cylinder (51) or lowering the load with winch drive (65).

Overstress valve means (13*d*) operates and is connected in the normally closed configuration to winch drive (65) in identically the same manner as overstress valve means (13*b*) operates and connects to elbow cylinder (59). The winch drive (65) is disabled from lifting a load any further once boom (11) has flexed beyond a predetermined degree thereby causing actuation of sensing valve (12) and overstress valve means (13*d*).

However, once the incoming pressure in winch drive (65) to lift the load is released, overstress valve means (13*d*) will reset in the same manner as overstress valve means (13*b*). Further lifting pressure will simply reactuate overstress valve means (13*d*), but pressure to lower the load through lowering line (66) will not reactuate the overstress valve means (13*d*) because, as shown in FIG. 6, fluid pressure in the lowering line (66) enters overstress valve means (13*d*) through port (47) which is blocked by land (50) of spool valve (37). Since the fluid pressure is against the side of land (50), no force is exerted against spring (40) and consequently spool valve (37) will not shift.

Thus, once boom (11) has flexed beyond a predetermined degree, the overstress condition may be relieved by either expanding the topping cylinder (51) through directly connected expansion line (57) or by lowering the load with the winch drive (65). As all overstress valve means, (13*a*), (13*b*), (13*c*), and (13*d*) are connected to the inlet port (26) of sensing valve (12), all said overstress valve means will actuate upon mechanical actuation of said sensing valve (12).

In considering this invention, it should be remembered that the present disclosure is illustrative only and the scope of the invention should be determined by the appended claims.

I claim:

1. Apparatus for sensing and relieving overstress conditions on a load transport boom in hydraulically powered load-moving equipment, comprising:

(a) a means for sensing both tensional and compressive forces longitudinally of the boom as a result of the boom being stressed to such a point as to flex beyond a predetermined degree of flex; and (b) an overstress relief means for the hydraulic power of such equipment constructed and arranged in controlled and actuated relation to said sensing means under both excess tensional and compressive forces whereby said sensing means actuates said overstress relief means when the boom flexes beyond a predetermined degree of flex, thereby prohibiting overstressed operation of the boom by either excess tensional or excess compressive forces.

2. The structure defined in claim 1, and at least one fluid powered drive unit constructed and arranged in controlling and moving relation to the load carried by the boom and in controlled relation to said overstress relief means whereby said overstress relief means disables boom stress-inducing operation of said drive unit when such overstress conditions in the boom causes flexing in the boom beyond a predetermined degree.

3. The structure defined in claim 2, wherein said overstress relief means includes:

(c) an overstress sensing valve constructed and arranged in controlled and actuated relation to said sensing means, and actuated thereby when the boom flexes beyond a predetermined allowable degree of flex; and (d) an overstress valve means connected in controlled relation to said sensing valve and constructed and arranged to disable boom stress-inducing operation of said drive unit when the boom flexes beyond its predetermined degree of flex.

4. The structure defined in claim 1, wherein said sensing means is comprised of an elongated sensing rod mechanically connected to the boom at each end and extending along its longitudinal axis, said sensing rod being mechanically connected to said overstress relief means and constructed and arranged to mechanically actuate the same when the boom flexes beyond a predetermined degree of flex.

5. The structure defined in claim 1, wherein said overstress relief means is mechanically connected to said sensing means and constructed and arranged to be operatively sensitive to both tensional and compressive forces exerted thereon longitudinally relative to the boom by said sensing means when the boom flexes beyond a predetermined degree of flex.

6. The structure defined in claim 1, wherein said sensing means is constructed and arranged to actuate said overstress relief means through mechanical forces longitudinally of the boom transmitted thereto through said sensing means as a result of the boom flexing beyond a predetermined allowable degree of flex.

7. The structure defined in claim 1, wherein said overstress relief means is constructed and arranged to facilitate adjustment of the predetermined allowable degree in flex of the boom.

8. Boom overload protection apparatus for hydraulic load-moving equipment, comprising:

(a) an elongated normally straight boom constructed and arranged to lift and transport a load connected thereto;

(b) at least one fluid powered drive unit constructed and arranged in controlling and moving relation to the load;

(c) an elongated sensing means connected at both ends to said boom and constructed and arranged to be operationally sensitive to a predetermined degree of flex in said boom and to move longitudinally of said boom as a function of tensional and compressive forces exerted thereon when said boom flexes;

(d) an overstress sensing valve constructed and arranged in controlled and actuated relation to said sensing means, and actuated thereby when said boom flexes beyond a predetermined degree of flex to thereby activate overstress valve means; and (e) overstress valve means connected in controlling relation to said motor and in controlled relation to said sensing valve, said overstress valve means being constructed and arranged to disable boom stress-inducing operation of said drive unit when said boom flexes beyond a predetermined degree.

9. The structure defined in claim 8, wherein said sensing valve is mechanically connected to said sensing means in a mechanically actuated relation thereto.

10. The structure defined in claim 8, wherein said sensing valve is constructed and arranged to be operationally sensitive to mechanical forces transmitted longitudinally of said boom through said sensing means as a result of said boom flexing beyond a predetermined allowable degree.

11. The structure defined in claim 8, wherein said sensing valve is comprised of:

(f) dual, mechanically actuated, flow valves constructed and arranged to release fluid pressure in the hydraulic equipment upon the mechanical actuation of either of said flow valves;

(g) a mechanical pivot-actuation arm mechanically connected to said sensing means and constructed and arranged to mechanically actuate one of said flow valves when said boom over-flexes in such manner as to apply tensional forces to said sensing means, and alternatively pivot and mechanically actuate the other of said flow valves when said boom over-flexes in such manner as to apply compressive forces to said sensing means; and (h) a pair of adjustment screws, each being constructed and arranged to adjust the degree of flexing in said boom required to actuate said sensing valve.

12. The structure defined in claim 8, wherein said sensing means is an elongated rod constructed of a rigid material and connected to said boom in flexsensing relation and in actuating relation to said sensing valve.

13. Boom overload sensing apparatus for hydraulic load-transferring equipment, comprising:

(a) a rigidly constructed elongated normally straight boom constructed and arranged to lift and transport a load;

(b) a plurality of fluid powered drive units, each being constructed and arranged to operate separately and bidirectionally in controlling and moving relation to such load;

(c) a mechanical elongated sensing rod connected at each end to said boom and extending along its longitudinal axis, said rod being constructed and arranged to sense longitudinal forces exerted thereon as a consequence of flexing of said boom beyond a predetermined allowable degree;

(d) a sensing valve connected to said sensing rod in mechanically actuated relation thereto, said sensing valve being constructed and arranged to activate overstress valve means and thereby disable overstress operation of said boom; and (e) overstress valve means connected in controlling relation to each of said motors and constructed and arranged to disable boom stress-inducing operation of each of said drive units when activated by said sensing valve as a result of an excess-flexing condition in said boom.

14. The structure defined in claim 13, said sensing valve including:

(f) a pair of interconnected mechanically actuated flow valves, each constructed and arranged to be actuatably sensitive to mechanical directional forces transmitted thereto through said sensing rod when said boom flexes beyond a predetermined allowable degree, thereby releasing fluid pressure from the hydraulic equipment and actuating said overstress valve means;

(g) a pivot-actuation arm mechanically connected to said sensing rod, and constructed and arranged to actuate one of said flow valves when said sensing rod is under tensional force from boom over-flexing, and pivotable for actuation of said other flow valve when said sensing rod is under compressive force caused by boom over-flexing; and (h) adjustment means for adjusting the degree of boom flex required to cause actuation of said sensing valve to thereby release fluid pressure from the hydraulic equipment.

15. The structure defined in claim 13, wherein said overstress valve means is constructed and arranged to allow operation of said fluid powered drive unit in an overstress-relieving direction after said boom has flexed beyond a predetermined degree.

16. A method of preventing overloading of a boom manuevered by hydraulic drive units comprising the steps of:

(a) sensing the degree of flexing of the boom caused by a load supported thereby; and (b) transmitting a force longitudinally of the boom to a hydraulic pressure relief means in the hydraulic line of the boom and thereby actuating the same in response to such sensing of an excessive degree of flexing in the boom, and thereby disabling boom stress-inducing operation of the boom's hydraulic drive units irrespective of whether the boom is subjected to excess tensional or excess compressive forces.

17. The method defined in claim 16 wherein sensing of the degree of flexing of the boom is accomplished mechanically through a sensing means disposed longitudinally of the boom and connected thereto at both ends.

18. Boom overload protection apparatus for hydraulic load-moving equipment, comprising:

(a) an elongated normally straight boom constructed and arranged to lift and transport a load connected thereto;

(b) at least one fluid powered drive unit constructed and arranged in controlling and moving relation to the load;

(c) a sensing means constructed and arranged to be operationally sensitive to a predetermined degree of flex in said boom;

(d) an overstress sensing valve constructed and arranged in controlled and actuated relation to said sensing means, and actuated thereby when said boom flexes beyond a predetermined degree of flex to thereby activate overstress valve means;

(e) overstress valve means connected in controlling relation to said motor and in controlled relation to said sensing valve, said overstress valve means being constructed and arranged to disable boom stress-inducing operation of said drive unit when said boom flexes beyond a predetermined degree;

(f) dual, mechanically actuated, flow valves constructed and arranged to release fluid pressure in the hydraulic equipment upon the mechanical actuation of either of said flow valves;

(g) a mechanical pivot-actuation arm mechanically connected to said sensing means and constructed and arranged to mechanically actuate one of said flow valves when said boom over-flexes in such manner as to apply tensional forces to said sensing means, and alternatively pivot and mechanically actuate the other of said flow valves when said boom over-flexes in such manner as to apply compressive forces to said sensing means; and (h) a pair of adjustment screws, each being constructed and arranged to adjust the degree of flexing in said boom required to actuate said sensing valve.

19. Boom overload sensing apparatus for hydraulic load-transferring equipment, comprising:

(a) a rigidly constructed elongated normally straight boom constructed and arranged to lift and transport a load;

(b) a plurality of fluid powered drive units, each being constructed and arranged to operate separately and bidirectionally in controlling and moving relation to such load;

(c) a mechanical sensing rod connected to said boom and extending along its longitudinal axis, said rod being constructed and arranged to sense flexing of said boom beyond a predetermined allowable degree;

(d) a sensing valve connected to said sensing rod in mechanically actuated relation thereto, said sensing valve being constructed and arranged to activate overstress valve means and thereby disable overstress operation of said boom;

(e) overstress valve means connected in controlling relation to each of said motors and constructed and arranged to disable boom stress-inducing operation of each of said drive units when activated by said sensing valve as a result of an excess-flexing condition in said boom;

(f) a pair of interconnected mechanically actuated flow valves, each constructed and arranged to be actuatably sensitive to mechanical directional forces transmitted thereto through said sensing rod when said boom flexes beyond a predetermined allowable degree, thereby releasing fluid pressure from the hydraulic equipmentand actuating said overstress valve means;

(g) a pivot-actuation arm mechanically connected to said sensing rod, and constructed and arranged to actuate one of said flow valves when said sensing rod is under tensional force from boom over-flexing, and pivotable for actuation of said other flow valve when said sensing rod is under compressive force caused by boom over-flexing; and (h) adjustment means for adjusting the degree of boom flex required to cause actuation of said sensing valve to thereby release fluid pressure from the hydraulic equipment.

* * * * *

UNITED STATES PATENT AND TRADEMARK OFFICE

CERTIFICATE OF CORRECTION

PATENT NO. : 4,660,729

DATED : April 28, 1987

INVENTOR(S) : Ralph E. Carbert

It is certified that error appears in the above-identified patent and that said Letters Patent is hereby corrected as shown below:

Column 11, line 21, ahead of "dual" insert --said sensing valve including (1)--;

line 25, cancel "(g)" and substitute therefor --(2)--;

line 34, cancel "(h)" and substitute therefor --(3)--;

Column 12, line 24, ahead of "a pair", insert --said sensing valve including (1)--;

line 32, cancel "(g)" and substitute therefor --(2)--;

line 39, cancel "(h)" and substitute therefor --(3)--;

line 30, cancel "equipmentand" and substitute therefor --equipment and--.

Signed and Sealed this

Twenty-second Day of March, 1988

*Attest:*

*Attesting Officer*

DONALD J. QUIGG

*Commissioner of Patents and Trademarks*